US006672980B1

(12) United States Patent
Walsh

(10) Patent No.: US 6,672,980 B1
(45) Date of Patent: Jan. 6, 2004

(54) SPORTS GOAL WITH COLLAPSIBLE FRAME

(76) Inventor: Robert J. Walsh, P.O. Box 776, Mount Pocono, PA (US) 18344

( * ) Notice: Subject to any disclaimer, the term of this patent is extended or adjusted under 35 U.S.C. 154(b) by 0 days.

(21) Appl. No.: 10/157,728

(22) Filed: May 29, 2002

Related U.S. Application Data

(60) Provisional application No. 60/294,581, filed on May 29, 2001.

(51) Int. Cl.[7] ..... A63B 63/00
(52) U.S. Cl. ..... 473/478; 473/471
(58) Field of Search ..... 473/478, 476, 473/477, 197, 421; 273/398–402; 52/651.1; 135/131

(56) References Cited

U.S. PATENT DOCUMENTS 2,922,653 A * 1/1960 O'Brien ..... 473/197
3,000,466 A * 9/1961 Johnson et al. ..... 182/118
3,190,406 A * 6/1965 Usher et al. ..... 52/646
3,235,038 A * 2/1966 Nesslinger ..... 182/62.5
3,566,503 A * 3/1971 Hoiness ..... 29/892.2
4,702,478 A * 10/1987 Kruse ..... 273/127 B
5,370,385 A * 12/1994 Joy ..... 473/421
5,839,733 A * 11/1998 Meeks et al. ..... 273/400
5,954,600 A * 9/1999 Gill ..... 473/478

* cited by examiner

*Primary Examiner*—Raleigh W. Chiu
*Assistant Examiner*—M. Chambers
(74) *Attorney, Agent, or Firm*—Charles A. Wilkinson; Clinton H. Wilkinson

(57) ABSTRACT

A portable hockey or soccer goal that can be readily converted between a fully open configuration and a fully closed storage or transport configuration without requiring any assembly or disassembly and having a rear and side stabilizing assembly such that the goal has improved strength while still being collapsible into a compact carrying bag.

9 Claims, 8 Drawing Sheets

SPORTS GOAL WITH COLLAPSIBLE FRAME

CROSS REFERENCE TO RELATED APPLICATION

This application claims the benefit of U.S. Provisional Application Ser. No. 60/294,581, filed May 29, 2001.

BACKGROUND OF THE INVENTION

1. Field of the Invention

The present invention relates to portable goals, and more particularly to a portable sports goal for practicing or playing sports such as hockey or soccer having a frame that can be erected and broken down in seconds, requires no further assembly of component parts, and folds both horizontally and vertically for easy storage or transportation in a carrying case or bag.

2. Preliminary Discussion

As originally conceived, games such as hockey and soccer involving the use of a goal are played or practiced on a rather large rink or playing field. However, slightly alternate versions of such games, usually played by children, are also popular wherein any generally flat surface such as a playground, field, driveway, or street can be used as a playing surface. While professional or league players are usually not responsible for setting up and maintaining the field or equipment, less organized groups must transport all of their own equipment, including one or more goal frames or structures, to and from the playing areas. This equipment also must be stored when not in use. While most sports equipment, such as a hockey stick or soccer ball, is relatively small or light that it is easy to transport, in general regulation sized hockey and soccer goals are typically considered too large, bulky, awkward or too heavy to routinely set up and break down and store, even if they do not have to be transported a substantial distance, and therefore are rarely used.

As a result, numerous portable sports goals having a relatively light frame structure which can be fairly quickly set up and then broken down or collapsed have been developed. Typically, known portable sports goals, examples of which are provided below, are comprised of a plurality of tubular plastic or metal pieces that must be assembled and disassembled into the shape of a goal frame, to which a net is then connected. Once assembled, which typically may require the use of at least one or more tools, it is often inconvenient or difficult to disassemble the goal after one use, particularly if it is envisioned that the goal will be used again shortly wherein reassembly will be required. On the other hand, assembled goals are bulky and therefore require a significant amount of space in a garage or the like, which space is usually at a premium.

Portable goals must also have a frame that is structurally strong enough to withstand impacts incurred during regular use. Such impacts may include direct impacts from the body of a ball player running into the goal, or the force from a ball or puck propelled at the goal at high speeds. The need for a lightweight goal that is portable and easy to set up and break down must therefore be balanced against the need for a goal having sufficient structural integrity to withstand regular impacts without breaking or collapsing.

3. Description of the Related Art

As indicated above, numerous portable goals that are relatively lightweight and are foldable in some manner are known in the prior art. However, each of such goals has one or more drawbacks, such as being foldable in only a horizontal or vertical plane rather than both, requiring assembly and disassembly of component parts, or being relatively fragile or unstable and therefore unable to withstand impacts sustained over a period of regular use.

For example, U.S. Pat. No. 4,702,478 issued to C. F. Kruse on Oct. 27, 1987, entitled "Collapsible Goal Frame," discloses a goal having a frame structure comprised of a plurality of connectable telescoping members, some having an elastic cord threaded therein to hold the members together, and wherein the lower members are weighted to give the frame added stability. To collapse the frame, the telescoping members are retracted. However, the Kruse goal does not appear to be collapsible in both a horizontal and vertical plane as in the present invention.

U.S. Pat. No. 5,246,299 issued to T. C. Carey on Sep. 21, 1993, entitled "Street Hockey Apparatus," discloses a street hockey practice goal having a tubular frame and a slanting floor panel so that a ball entering the goal will tend to roll back towards the player. The frame is essentially comprised of three U-shaped members secured together via elbow joints, which frame is not collapsible or foldable as in the present invention.

U.S. Pat. No. 5,427,381 issued to A. G. Macaluso et al. on Jun. 27, 1995, entitled "Sports Net," discloses a sports net having a frame comprised of an elastic material such as springwire having a memory so that the frame automatically tends to move to an open position unless constrained by a plurality of straps. The Macaluso frame can also be folded into a plurality of concentric rings so that it is generally flat, but is not foldable in the same manner as in the present invention. In addition, the Macaluso goal does not have the appearance of an ordinary soccer or hockey goal, and therefore may be less desirable to some players if used with such sports.

U.S. Pat. No. 5,496,040 issued to J. D. Amburgey et al. on Mar. 5, 1996, entitled "Foldable Soccer and Hockey Goal and Equipment Set," discloses a goal comprised of two right triangular side supports hingedly secured to a forwardly inclined middle section. The side supports can be folded on such hinges so that they are flat against the middle section when the goal is not in use, and in addition can be filled with sand or water to give the goal increased stability. The Amburgey goal frame is only foldable in a vertical plane and not horizontally so that it cannot be stored as compactly as the present goal.

U.S. Pat. No. 5,533,733 issued to R. J. Dirnbeck on Jul. 9, 1996, entitled "Sports Goal," discloses a foldable sports goal comprised of two U-shaped frames, preferably made from PVC pipe, which are held in an erect position by a removable dogleg brace. The U-shaped frames are connected at their open ends via a pivot brace so that the frame can be quickly converted between a folded and unfolded position. However, the Dirnbeck goal also is only foldable in a vertical plane, and in addition the dogleg brace must be connected and removed to the goal each time the goal is assembled or disassembled.

U.S. Pat. No. 5,539,957 issued to T. W. Schmidt on Jul. 30, 1996, entitled "Collapsible Goal Having An Articulated Frame," discloses a collapsible sports goal frame wherein the tubular members comprising the frame are hinged and lockable. The Schmidt goal is collapsible both vertically and horizontally. However, Schmidt does not teach the use of slidable side or rear stabilizing members as in the present invention, which members significantly increase the overall structural integrity of the present inventor's goal.

U.S. Pat. No. 5,842,939 issued to A. Pui et al. on Dec. 1, 1998, entitled "Portable Sporting Goal Framework and Net," discloses a portable sports goal frame wherein the goal frame is comprised of a main frame and a pair of dogleg type rear supports. The main frame is comprised of a plurality of interconnecting components, all of which are connected by an elastic cord running within the tubular frame structure, promoting proper mating of the components during assembly. The net is preferably attached to the framework via hook-and-loop type fasteners secured directly to the outer surface of the frame. Pui et al. also uses a unique twist and grip mechanism to connect the various components. However, such invention still requires assembly and disassembly of the components to convert the frame between a collapsed and erect configuration.

U.S. Pat. No. 5,857,928 issued to T. E. Stewart on Jan. 12, 1999, entitled "Portable Soccer Practice Goal Net," discloses a soccer goal frame having piston-like members embedded in the frame so that the frame will tend to better absorb an accidental impact from a player or the like, with the intent being to provide a goal that decreases the possibility of a player injury caused by running into the goal. The component parts of such goal still have to be assembled and disassembled, however, so that it takes minutes to set up and break down, rather than seconds as in the present invention.

U.S. Pat. No. 5,954,600 issued to S. Gill on Sep. 21, 1999, entitled Folding Soccer Goal," discloses a soccer goal comprised of a horizontal crossbar situated between a pair of vertical posts supported by backstay bars. The Gill goal frame is collapsible both vertically and horizontally so that it can be stored and carried in an elongated carrying bag. However, such frame is not nearly as stable as the present inventor's frame, even though in one embodiment corner braces deposed between the vertical posts and backstay bars are provided as it may collapse more easily upon encountering an impact, strong wind, or the like. The cross and scissors-type stabilizing members in the present frame therefore make it much more structurally stable than the Gill frame structure.

While the prior art in the field of portable goals is quite developed, there remains a need for a portable goal that is foldable or collapsible in both a horizontal and vertical plane so that the goal can be stored in a minimal amount of space or area, that does not require any assembly or disassembly of component parts when it is being set up or broken down, and at the same time is sturdy or stable enough to withstand regular impacts commonly encountered during use. The present inventor has recognized this need and, after much trial and error, has developed a portable sports goal that is foldable in both a horizontal and vertical plane so that the goal can be easily fitted into a carrying bag for transport or storage. In addition, no assembly of the component parts of the net or frame of the goal is required during set up or break down, which make the present goal significantly more attractive than prior art goals. Finally, the present goal includes side and rear slidable stabilizing members which make the frame structurally more stable than other prior art goals which are collapsible in the same or similar manner. The present goal therefore represents a significant improvement over such prior art goals.

OBJECTS OF THE INVENTION

It is therefore an object of the present invention to provide a durable and portable sports goal having a frame that can be converted between a fully erect or open position and a collapsed or storage position in a matter of seconds.

It is further object of the invention to provide a sports goal that can be adapted for used with a variety of sports such as hockey or soccer, or as a ball kickback device.

It is a still further object of the invention to provide a sports goal that is collapsible in both a horizontal and vertical plane so that a more compact configuration for easier transport and storage results.

It is a still further object of the invention to provide a sports goal have rear and side stabilizing members that give the goal improved strength characteristics but wherein no additional assembly or disassembly is required.

It is a still further object of the invention to provide a goal frame structure wherein the side stabilizing members are pivotally secured in couplings so that they are slidable on the front and rear uprights.

It is a still further object of the invention to provide a goal frame structure wherein the rear stabilizing members are arranged in a scissors-type configuration.

It is a still further object of the invention to provide a sports goal that is inexpensive to produce and manufacture.

Still other objects and advantages of the invention will become clear upon review of the following detailed description in conjunction with the appended drawings.

SUMMARY OF THE INVENTION

A sports goal having a framework that can be set up and broken down in a matter of seconds is provided, wherein no assembly or disassembly of component parts is required, wherein the goal frame is collapsible both horizontally and vertically, and wherein the frame is structurally more stable than prior art foldable or collapsible goals. The frame is preferably comprised of a plurality of tubular members that are slidably and pivotally joined together by a plurality of strategically placed couplings and hinges which hold the goal in a fully expanded or open configuration for use and facilitate folding or collapsing of the goal for storage in a carrying bag. The tubular members are preferably made from hollow plastic pipe, preferably polyvinylchloride (PVC), although other materials such as aluminum, steel, and the like may also be used. Slidable side braces and a rear scissors type stabilizing device have been provided which substantially increased the stability of the frame but still allow the frame to be folded both horizontally and vertically into a compact package for storage and transport or the like. The tubular members may also be in various diameters and lengths depending upon the size and type of goal constructed. The framework can also be used for other purposes such as a kickback.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

In prior art portable sports goals, used in sports such as hockey or soccer, a trade off was made between the strength and stability of the goal, its ease of transport and storage, the amount of time required to assemble and disassemble the component parts of goal frame, and the extent to which the goal is foldable or collapsible in a horizontal and vertical plane. As evidenced by the prior art references discussed above, numerous attempts to provide portable sports practice and playing goals have been made. However, each of such prior goals has one or more drawbacks when compared with the present inventor's arrangement. For example, some of such prior art goals may fold flat, but are not collapsible and therefore are still relatively bulky and require a relatively large, albeit narrow, space for storage or transport. Other goals, while somewhat easier to transport and store in that they can be folded into a more compact package, are less stable and prone to breaking. One or more component parts of still other portable goals must be assembled and disassembled each time they are used, which makes them more difficult and time consuming to set up and break down and therefore somewhat or much less desirable The present inventor has now designed a portable sports goal that not only can be easily transported and stored, but also having a frame that can be more easily converted between an open or deployed configuration when it is desired to be used and a collapsed configuration when such use has ended and the goal is ready to be transported or stored. Not only is the present goal easy to both deploy and collapse, but this can be done without any need to assemble or disassemble any of the component parts of the goal frame of the goal, so that it can be set up and broken down in seconds rather than minutes. The inventor has also provided side and rear stabilizing members slidably secured to the vertical uprights and posts which give the goal much greater lateral and side-to-side stability than prior art portable goals. When fully collapsed and placed in its carrying case, the goal can be easily transported in the back seat of a car, and can be set up and broken down by a single person. The goal preferably comes fully assembled and can be provided in a variety of sizes for use in different sports, or even as a kickback device, without requiring any changes to the basic structural arrangement.

Figure 1:
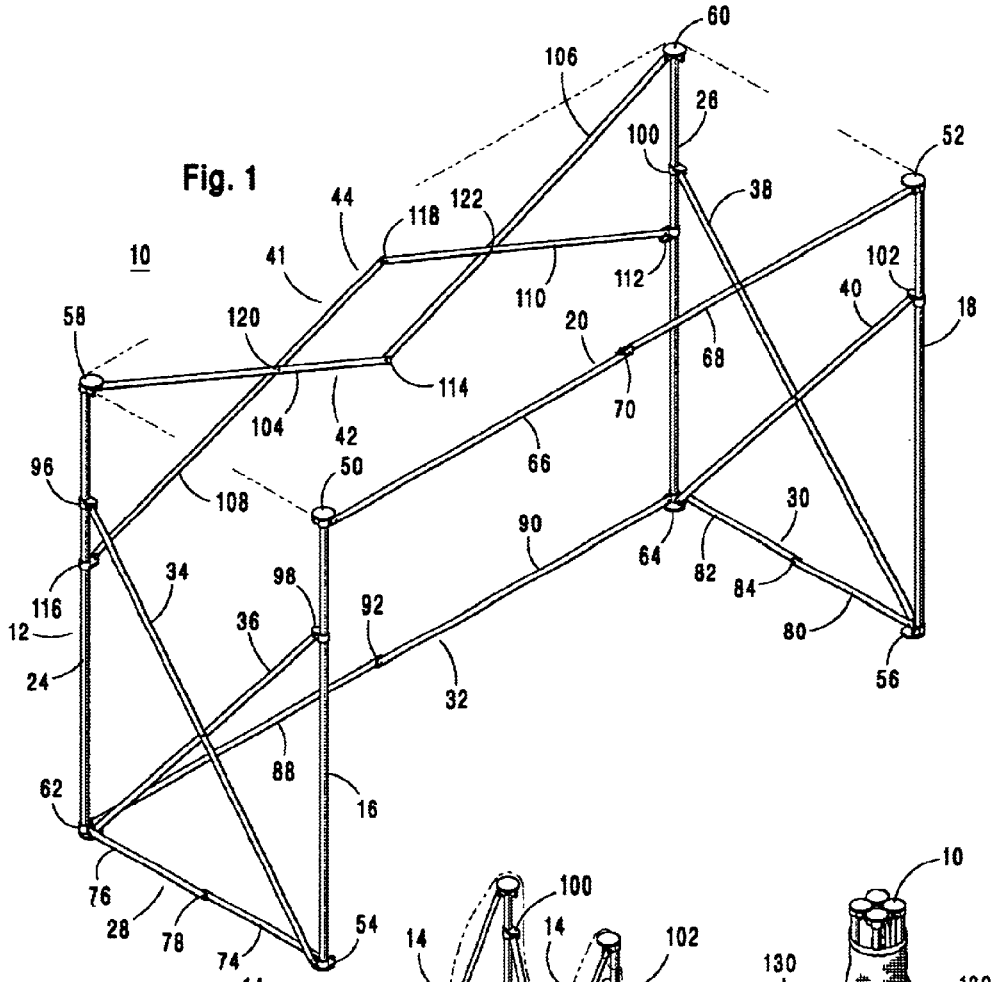
FIG. 1 is a perspective view of the collapsible sports goal of the present invention in a fully open or expanded configuration with the net shown only in outline.
Figure 2:
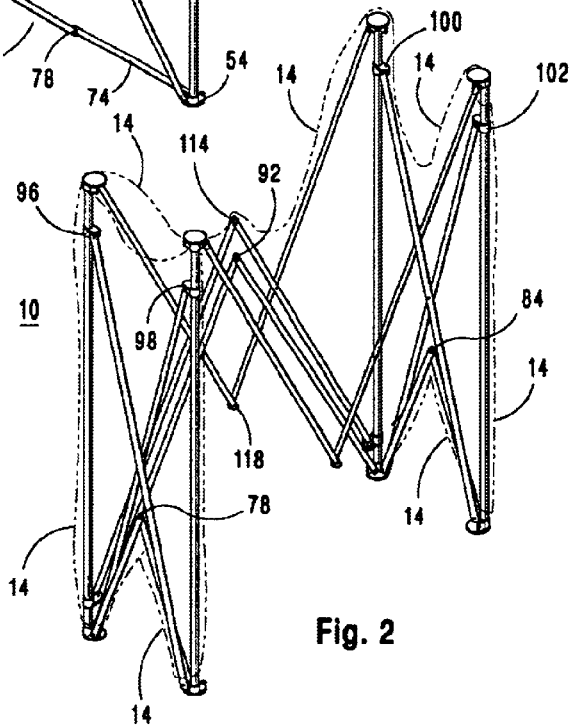
FIG. 2 is a perspective view showing the goal in a partially collapsed configuration.
Figure 3:
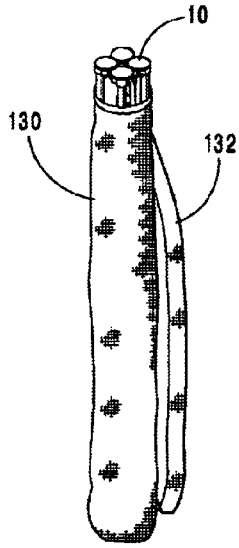
FIG. 3 is a perspective view showing the goal in a fully collapsed configuration and enclosed in a carrying bag for transport or storage.

Referring now to the drawings, there is shown in FIGS. 1–6 a preferred embodiment of a foldable hockey or soccer goal, generally indicated by reference numeral 10, in accordance with the present invention. FIG. 1 shows goal 10 in an open or fully expanded configuration, and is generally comprised of a frame or framework 12 and netting 14 attached to frame 12, shown in outline in FIG. 1, which covers the sides, top, and rear of goal 10 with the front being left open in the usual manner. Frame 12 is preferably constructed of a plurality of articulated lightweight tubular members that are slidably and pivotally connected together by a plurality of strategically placed couplings and hinges which hold goal 10 in a fully expanded or open configuration for use and facilitate folding or collapsing of the goal for storage in carrying bag, as illustrated in FIG. 3. The tubular members are preferably made from hollow plastic pipe, preferably polyvinylchloride (PVC), although other materials such as aluminum, steel, and the like may also be used. The tubular members may also be in various diameters and lengths depending upon the size and type of goal constructed. The sliding and corner couplings are preferably constructed of similar materials, the specifics of which described in more detail below.

In the embodiment shown in FIGS. 1–6, frame 12 is generally comprised of a pair of front vertical posts or uprights 16 and 18, horizontal cross bar 20, a pair of rear vertical posts or uprights 24 and 26, hinged side supports 28 and 30, horizontal hinged rear ground support 32, sliding side post stabilizing members 34, 36, 38, and 40, and rear post stabilizing structure 41 comprised of stabilizing members 42 and 44. In addition, two-way couplings 50 and 52 are secured to the top ends of front vertical posts 16 and 18, while three-way couplings 54 and 56 are secured to the bottom ends of front vertical posts 16 and 18. Similarly, two-way couplings 58 and 60 are situated on the top ends of rear vertical posts 24 and 26, while three-way couplings 62 and 64 are secured to the bottom ends of the rear vertical posts. Front couplings 50–56 are shown in more detail in FIG. 4, while rear couplings 58–62 are shown in more detail in FIG. 5.

Horizontal cross bar 20 is preferably formed in two sections or segments 66 and 68. First segment 66 is pivotally secured in coupling 50 while second segment 68 is pivotally secured in coupling 52, which couplings are attached on the upper end of front vertical posts 16 and 18, respectively. Segments 66 and 68 are pivotable in a vertical plane in couplings 50 and 52 on a pivot pin arrangement of a conventional type. The inner ends of segments 66 and 68 are preferably detachably securable together by retaining means 70, which means is preferably an eyescrew secured through matching threaded orifices 72 in such members. However, other means for detachably securing segments 66 and 68 together in a generally horizontal orientation may also be used, such as a clamp, brace, latch, or other securing members. For example, see button hinges 156 in FIGS. 8–10. When goal 10 is in a fully erect or expanded configuration, front vertical posts 16 and 18 and horizontal cross bar 20 form the mouth of the goal. See also FIG. 4, which shows couplings 50 and 52 in more detail with a portion of members 46 and 48 cut away, indicated by the dotted lines. Couplings 50 and 52 are described in more detail below.

Horizontal side supports 28 and 30 are preferably constructed of two sections or segments, with side support 28 being comprised of segments 74 and 76, and side support 30 being comprised of segments 80 and 82. Segment 74 of side support 28 is pivotably connected in coupling 54 on the bottom end of front vertical post 24, while segment 76 is pivotally connected in coupling 62 on the bottom end of rear vertical post 24. Segments 74 and 76 are hingedly secured together via locking pivot or hinge 78. Similarly, segment 80 of side member 30 is pivotally connected in coupling 56 on the bottom end of front vertical post 18, while section 82 is pivotally connected in coupling 64 on the bottom end of rear vertical post 26, with segments 80 and 82 hingedly secured together via locking or pivot hinge 84. Rear support 32 is also preferably similarly comprised of a pair of segments 88 and 90, with segment 88 pivotally secured in coupling 62 on the bottom end of rear vertical post 24, and segment 90 pivotally secured in coupling 64 on the bottom end of rear vertical post 26. Segments 88 and 90 are also similarly hingedly secured together by locking or pivot hinge 92. Hinges 78, 84 and 92 are preferably of a locking type known in the prior art so that members or supports 28, 30 and 32 are detachably locked in a horizontal position when goal 10 is fully erect, but so that upward manual force on such members will cause the hinges to unlock and pivot upwardly as shown in FIG. 2.

Sliding side post stabilizing members 34–36 and 38–40 are provided to increase the stability of frame 12, particularly between the front and rear vertical posts 16 and 24 and 18 and 26, respectively. Stabilizing member 34 is pivotally connected in coupling 54 on the bottom end of front vertical post 16. Member 34 is longer than hinged side supports 28 and 30 and is angled upwardly so that its opposite end is slideably connected to rear vertical post 20 via slideable coupling 96. Stabilizing member 36 is pivotally connected on one end to coupling 62 on the bottom end of rear vertical post 24, while its other end is similarly angled upwardly and pivotally connected vertical post 16 via slideable coupling 98. A similar arrangement is provided for side braces 38 and 40. Vertical post side brace 38 is pivotally connected on one end to coupling 56 on the bottom end of front vertical post 18, and on its other end to coupling 100, which is angled upwardly and slideably connected to rear vertical post 26. Similarly, vertical post side brace 40 is pivotally connected on one end to coupling 64 on the bottom end of rear vertical post 22, while its other end is angled upwardly and pivotally connected to coupling 102, which is slideably connected to front vertical post 18. In general, couplings 96, 98,100 and 102 slide downwardly on posts 24,16, 26 and 18, respectively, when frame 12 is moved from a collapsed to fully erect position, and vice versa when the frame is again collapsed.

Just as side braces 34–40 increase the stability of goal 12 between the front and rear vertical posts, rear stabilizing structure 41 is provided to increase the stability of goal 10 between the rear vertical posts 24 and 26 while still enabling frame 12 to collapse in both a vertical and horizontal direction without requiring any further assembly or disassembly of components. Structure 41 is generally comprised of stabilizing members 42 and 44 which are arranged in a scissors-type orientation, best shown in FIG. 1. Each member 42 and 44 is preferably comprised of a pair of hinged segments or sections, with member 42 being comprised of sections 104 and 106 and member 44 being comprised of sections 108 and 110. The outer end of stabilizing member section 104 is pivotally secured in coupling 58 located on the top end of rear vertical post 24, while the outer end of stabilizing member section 106 is pivotally secured in coupling 60 on the top end of rear vertical posts 26. The inner ends of sections 104 and 106 are hingedly secured together via pivot pin 114. Stabilizing member 44 is arranged so that the outer end of stabilizing member section 108 is secured in coupling 116 which is slideably secured on rear vertical post 24, while the outer end of stabilizing member section 110 is pivotally secured in coupling 112 which is slideably secured on rear vertical post 26. The inner ends of sections 108 and 110 are hingedly secured together on pivot pin 118. As best shown in FIG. 1, the combined length of sections 104 and 106 as well as of sections 108 and 110 is longer than the length of front cross bar 20 and the distance between rear uprights 24 and 26 in a fully expanded configuration, so that when the goal is in a fully deployed or open position, stabilizing members 42 and 44 are slightly angled or scissored in relation to cross bar 20. Preferably, sections 104 and 106 of stabilizing member 42 are angled upwardly, while sections 108 and 110 of stabilizing member 44 are angled downwardly. In addition, sections 104 and 108 as well as sections 106 and 110 overlap as shown, and preferably are secured together on pivot pins 120 and 122, respectively, so that a scissors type arrangement is maintained upon folding.

Figure 6:
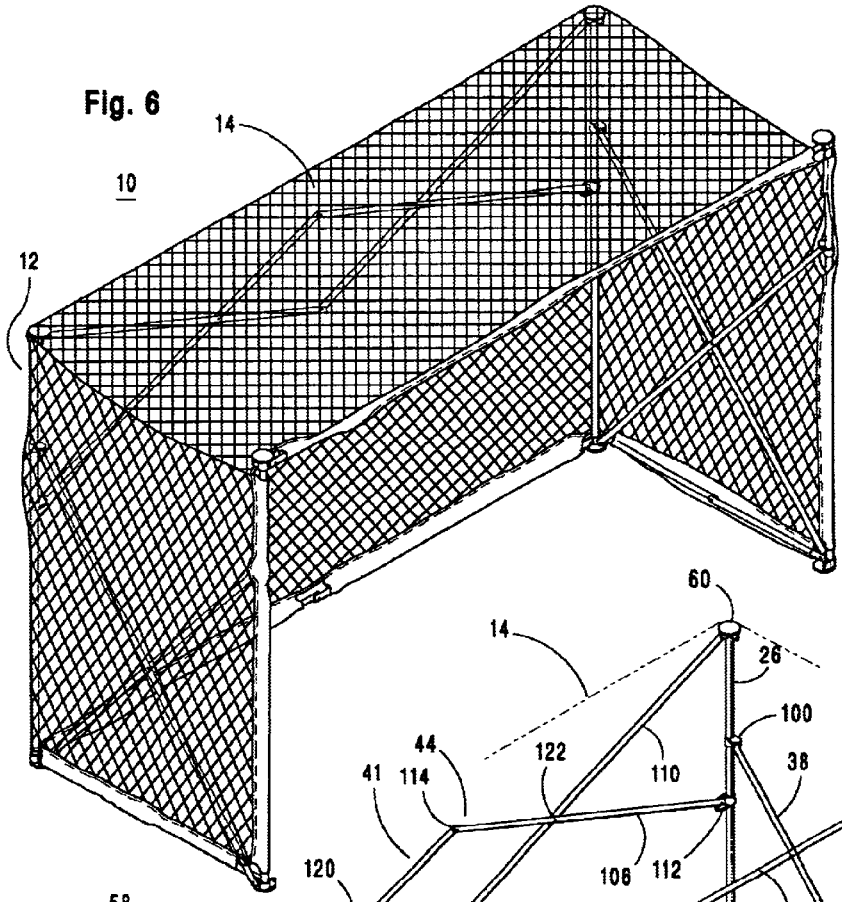
FIG. 6 is a perspective view of the sports goal of the invention similar to FIG. 1 but with the net shown situated around the sides and rear of the goal frame.

Net 14, shown in FIG. 6, is preferably made of a durable nylon or cotton mesh material and covers the back, top and sides of frame 12, with the front or mouth of the goal left open. In the preferred embodiment, net 14 is secured to the tubular members of frame 12 by strategically placed Velcro® straps. However, net 14 can also be attached by other suitable means, such as by looping the ends of the net around the tubular members and sewing, or by using a separate strapping device. For example, see the elastic straps holding the netting on the kickback shown in FIG. 12.

The combination of side braces 34–36 and 38–40 as well as the scissors-style stabilizing members 42 and 44 and the manner in which the framework is coupled together significantly increase the overall stability of the goal 10. Prior art foldable or collapsible goals are more susceptible to swaying and eventually breaking if bumped by a hockey stick, goalie, player or the like, and generally cannot withstand strong or even moderate impacts as well as the present goal. Some of such prior art goals also cannot withstand direct impacts from, for example, a soccer ball, hockey puck, or street hockey ball, which are shot, kicked, or otherwise propelled towards the goal at fairly high speeds. Even a strong or steady wind can cause some prior art foldable or collapsible goals to bend or sway. Side braces 34–36 and 38–40 prevent the front and rear uprights from bending inwardly, while stabilizing members 42 and 44 prevent either of the rear uprights of the goal from bending to the side. In addition, braces 34–36 and 38–40 and stabilizing members 42 and 44, as well as the rest of the tubular members comprising frame 12 work in unison so that goal 10 can better resist bending or breaking to due impacts received at a wide variety of speeds, angles, and frequency.

Figure 4:
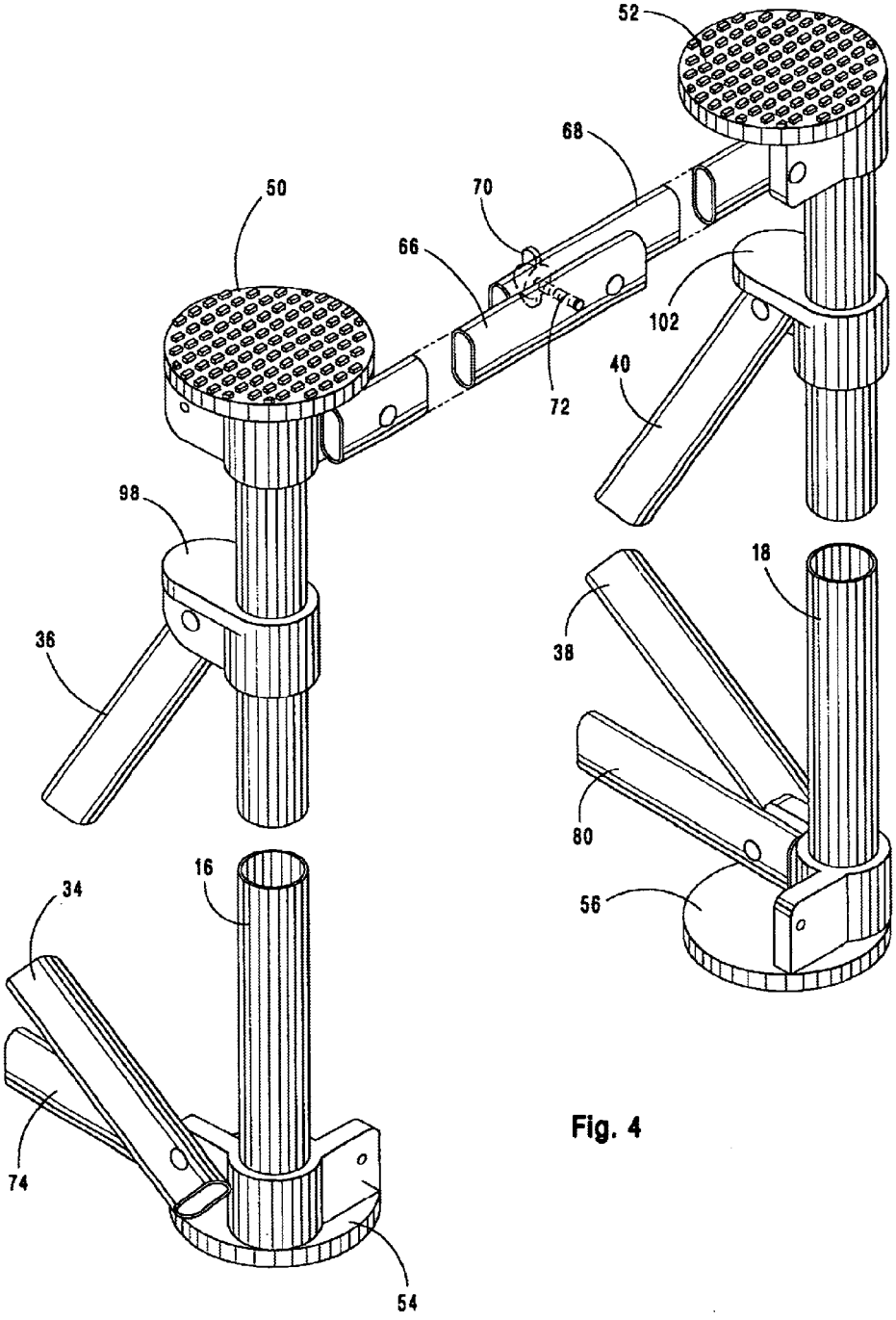
FIG. 4 is an isometric view of the top and bottom front corner couplings and sliding coupling members of the invention with the tubular members shown in partial view.
Figure 5:
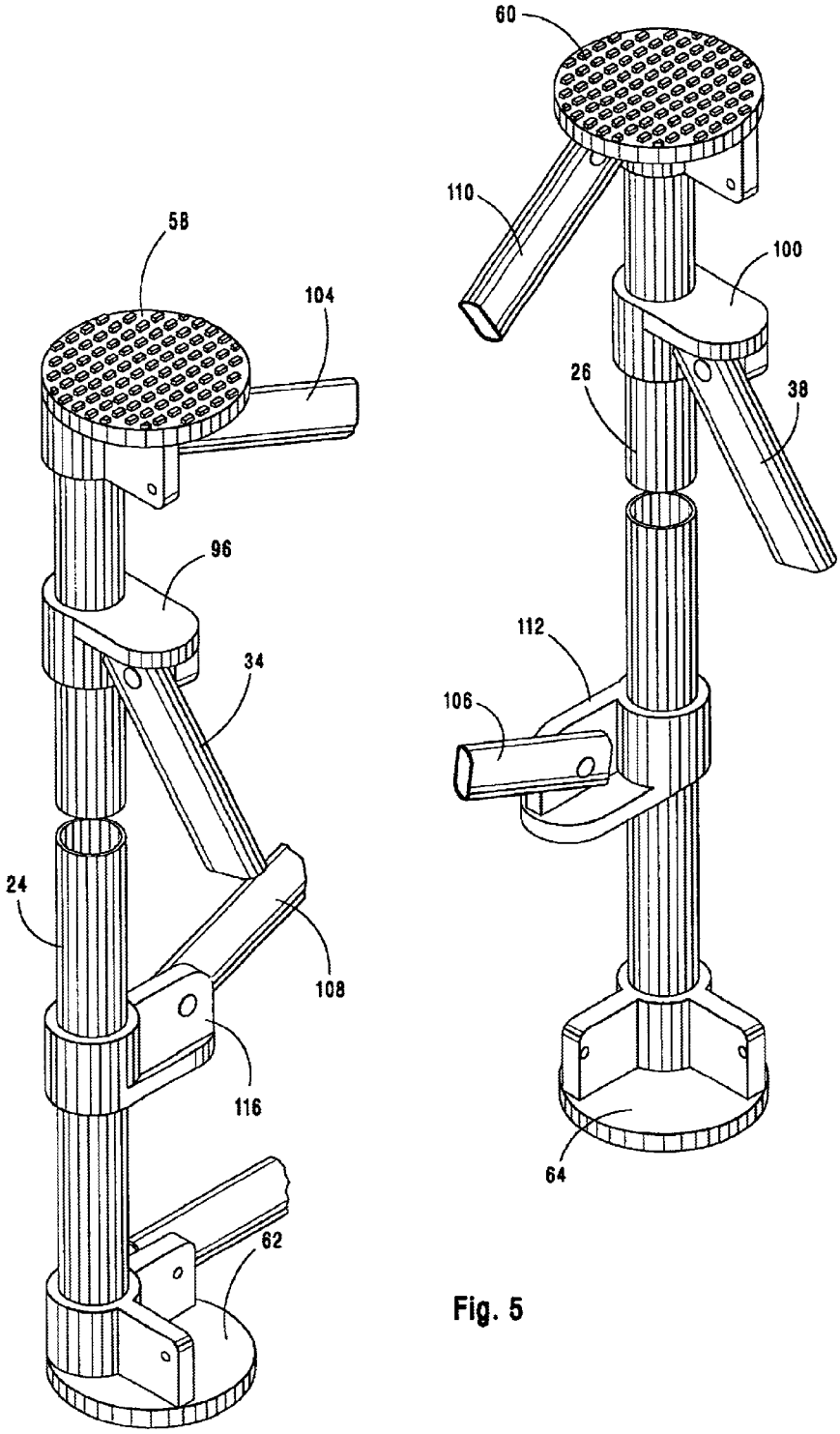
FIG. 5 is an isometric view of the top and bottom rear corner couplings and sliding coupling members of the invention with the tubular members shown in partial view.

As indicated above, the couplings can be provided in various forms. Referring to FIGS. 4 and 5, couplings 50, 52, 54, 56, 58, 60, 62 and 64 are essentially identical, and include a base portion, a generally circular portion for receiving the ends of the tubular members, and a pair of stem portions situated at right angles to which up to four tubular members can be pivotally attached, preferably using a pivot pin arrangement. The bottom of the base portion is generally planar so that it can also serves as a ground contacting member for the framework. The upper couplings 50, 52, 58, and 60 are situated upside down in relation to lower couplings 54, 56, 62, and 64, and can be of a different design wherein the base portion is more rounded, since they do not have to serve as ground contacting members. Such couplings are preferably made of PVC plastic similar to the tubular members. Slidable couplings 96, 98, 100, and 102 include an orifice into which tubular members 16, 18, 24, and 26 are passed, and a stem portion for pivotally securing of side braces 34, 36, 38, and 40. Such slidable couplings are also preferably made from PVC plastic.

Preferably, goal 10 will be packed in fully assembled form, although it could also be packed in unassembled form. To deploy the goal 10, assuming it has already been assembled, it is removed from the carrying case or bag 130, shown in FIG. 3, and is placed in a generally upright position, such as shown in FIG. 2, preferably on a relatively flat ground surface, with front and rear vertical posts 16–18 and 24–26 supported on the flat bottom portion of coupling members 54–56 and 62–64, respectively. Alternative known ground contacting members may also serve as feet for the goal, but generally should provide a relatively stable base for the goal. Next, the front and rear uprights 16,18, 22, and 26 are pulled outwardly away from each other. It does not matter which combination of front and rear uprights are pulled outwardly away from each first, or if they are pulled outwardly simultaneously. For example, first front uprights 16 and 18 and rear uprights 24 and 26 can be moved outwardly away from each other, and then front and rear uprights 16 and 24 and front and rear uprights 18 and 26 can be moved away from each other, or vice versa, or simultaneously. A single individual can set up the goal in a matter of seconds, although two persons may be able to set up the goal just as fast or even slightly faster. As rear uprights 24 and 26 are manually moved outwardly away from each other more or less as far as possible, stabilizing members 42 and 44 will also move outwardly, with sliding coupling members 112 and 116 of stabilizing member 41 tending to slide upwardly on rear uprights 24 and 26. In addition, as adjacent pairs of front and rear uprights 16 and 24 and 18 and 26 are moved outwardly away from each other, sliding couplings 96, 98, 100 and 102 securing the side stabilizing members to the front and rear uprights will tend to slide or be pulled downwardly on the front and rear uprights, respectively. Locking hinges 78 and 84 of side members 28 and 30 and locking hinge 92 on rear crossbar 32 are then pushed downwardly until the segments of such members are substantially horizontal, wherein they will be automatically lock into such position. Sections 66 and 68 of horizontal crossbar 20 are then manually moved to a horizontal position, where they are secured by tightening retaining means 70. Goal 10 should now be in a completely erect configuration ready for use.

To break down goal 10, first retaining means 70 securing horizontal crossbar sections 66 and 68 together is manually loosened so that such sections are either disengaged from each other or are loose enough so that they swing downwardly under their own weight. At about the same time, hinges 78 and 84 of side members 28 and 30 as well as hinge 92 of rear ground crossbar 32 are unlocked by manually grasping such members and crossbar and pivoting them upwardly. As shown in FIG. 2, this allows front and rear uprights of goal 10 to be folded or moved towards each other. Moving adjacent front and rear uprights 16 and 24 and 18 and 26 towards each other causes the upper ends of side braces 34–36 and 38–40 to slide upwardly on the uprights. Similarly, as rear uprights 24–26 are moved towards each other, stabilizing members 42 and 44 begin to fold inwardly in a scissors-like fashion, with the lower slideably coupled ends of the stabilizing member 44 sliding downwardly on the respective rear vertical supports. Such inward motion is continued until the front and rear vertical supports are brought as close to each other as possible. Goal 10 can then be easily slipped back into carrying bag 130 for storage or transport, with shoulder strap 132 used if desired.

In general, crossbars 20 and 32 will be longer then either side members 28 and 30, or uprights 16–18 and 24–26, particularly if such goal is designed to be used or mimic the size of a regulation hockey goal. Sample dimensions may include 54"W×44"H, 72"W×48"H"30"D, 120"W×72"H, or 144"W×72"H. It will be understood, however, that such dimensions are not intended to be limiting, and that in practice, particularly if intended for use by younger children, the goal may often have smaller than normal dimensions to accommodate such younger children, although of course goals having even larger dimensions may also be provided.

Figure 7:
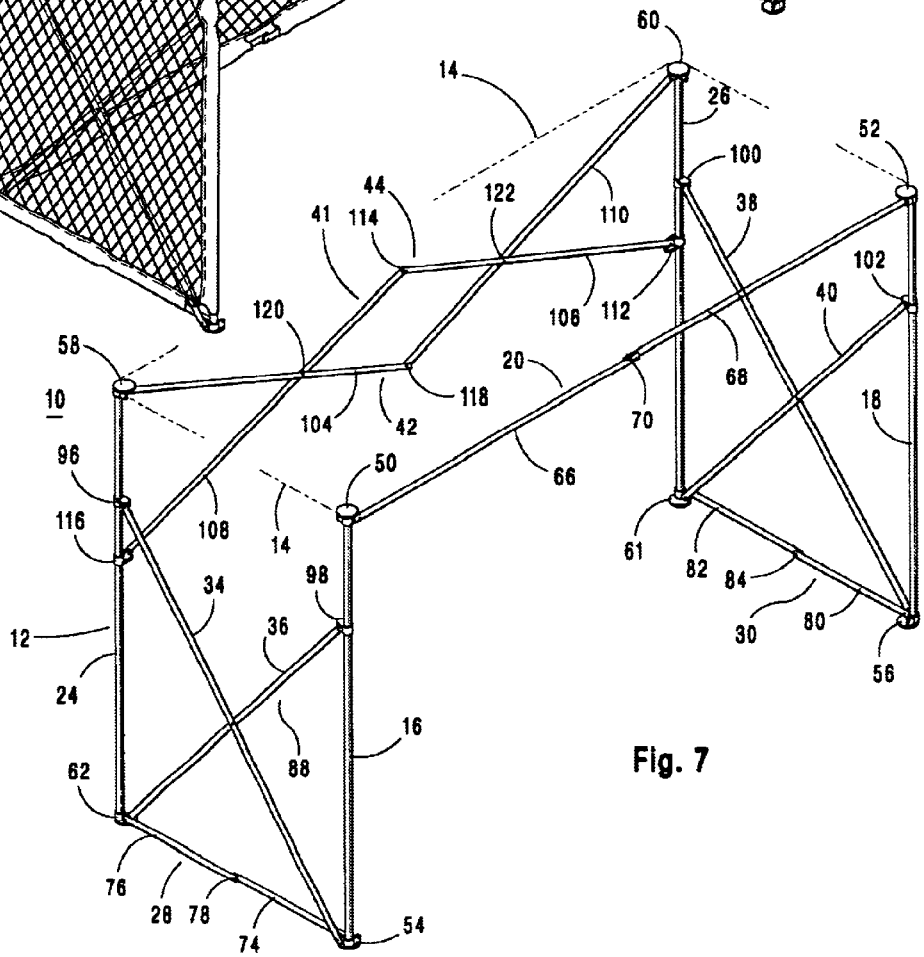
FIG. 7 is a perspective view of an alternative embodiment of the invention.

FIG. 7 is a perspective view of an alternative embodiment of the invention wherein rear ground crossbar 92 has been omitted. Omitting the rear crossbar may be desirable if the goal is to be set up on a non-level playing surface, where such crossbar might rest on such uneven surface and cause the goal to be tilted or to rock or sway upon relatively light contact or impacts, which is generally undesirable. While it is not thought that this situation will frequently occur, by utilizing the present inventor's unique frame arrangement, the structural integrity of the frame is only slightly diminished without such ground crossbar.

Figure 8:
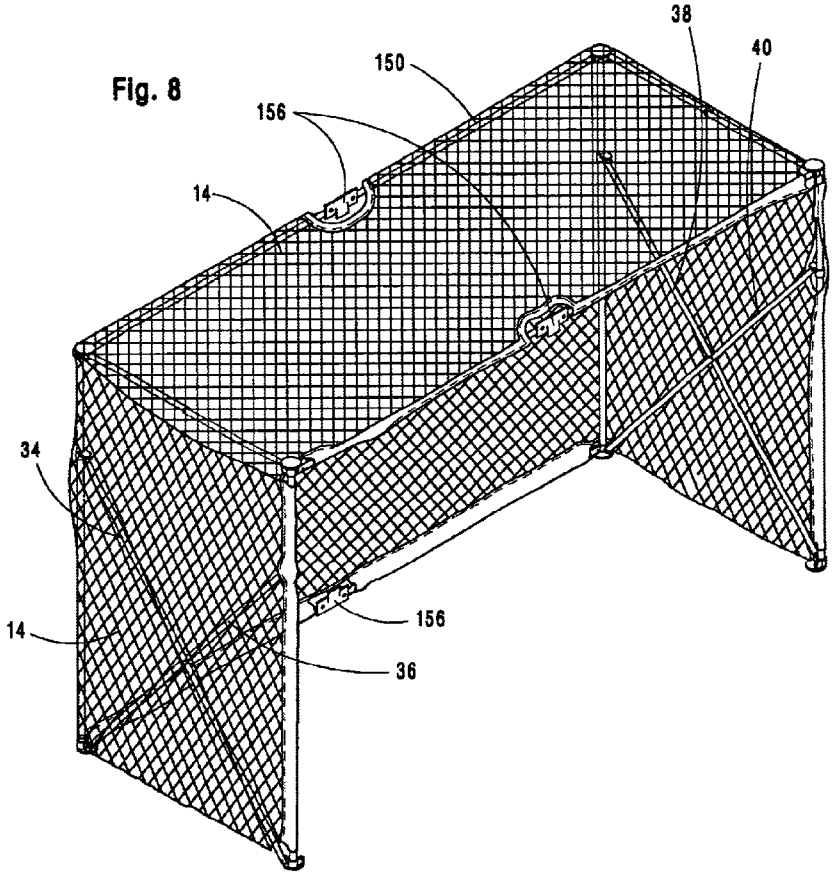
FIG. 8 is a perspective view of another alternative embodiment of the invention in a fully erect configuration.
Figure 9:
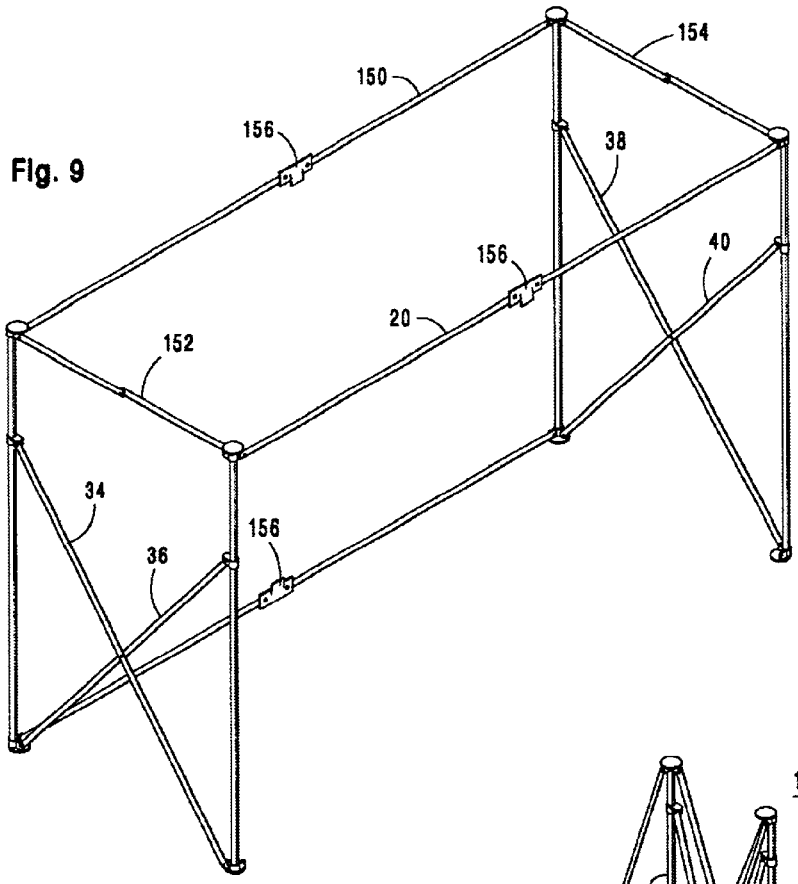
FIG. 9 is a perspective view of the embodiment of the invention shown in FIG. 8 with the net removed.
Figure 10:
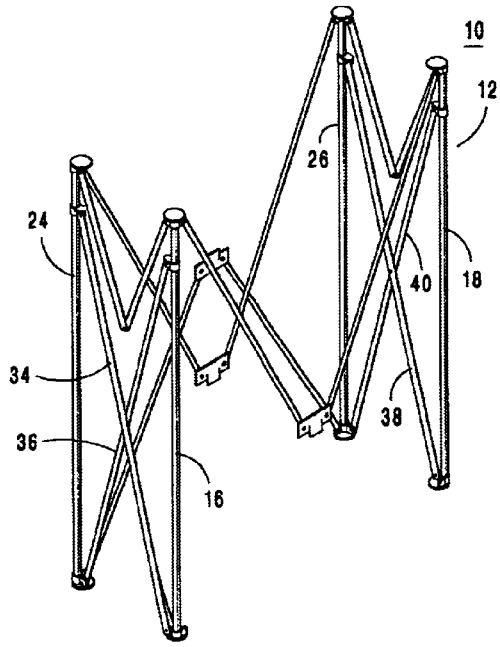
FIG. 10 shows the goal of FIGS. 8 and 9 in a partially collapsed position.

FIGS. 8–10 illustrate another slightly less preferred embodiment of the invention wherein the slidable side upright stabilizing members 34–36 and 38–40 are maintained, but the rear stabilizing members 42 and 44 have been replaced with straight rear horizontal crossbar 150, similar to front horizontal crossbar 20. The hinged side ground members 28 and 30 described above with reference to the preferred embodiment shown in FIGS. 1–6 have also been omitted, and have been replaced by upper hinged members 152 and 154 extending between front crossbar 20 and rear crossbar 150. An alternative locking mechanism 156 is also provided on each of the hinges pivotally securing the inner ends of the segment comprising the horizontal crossbars 20, 32, and 150, respectively. Such mechanism 150 is essentially a button activated hinge which automatically locks when the segments of the crossbar are moved to a horizontal position, but is unlocked by pressing a release button, which unlocks the hinge and again allows the segments to be pivoted downwardly in the case of crossbars 20 and 150, and upwardly in the case of crossbar 32. As shown in FIG. 10, wherein the goal 10 is shown approximately 75% unfolded, the frame 12 folds in essentially the same manner as described above, so that when the uprights 16, 18, 24, and 26 are brought towards each other, the upper ends of side braces 34, 36, 38, and 40 slide upwardly on couplings slidably secured to such uprights, while the crossbars and side frame members are pivoted about their hinge point so that the goal 10 can be folded both vertically and horizontally and stored or transported in carrying case 130 shown in FIG. 3.

Figure 11:
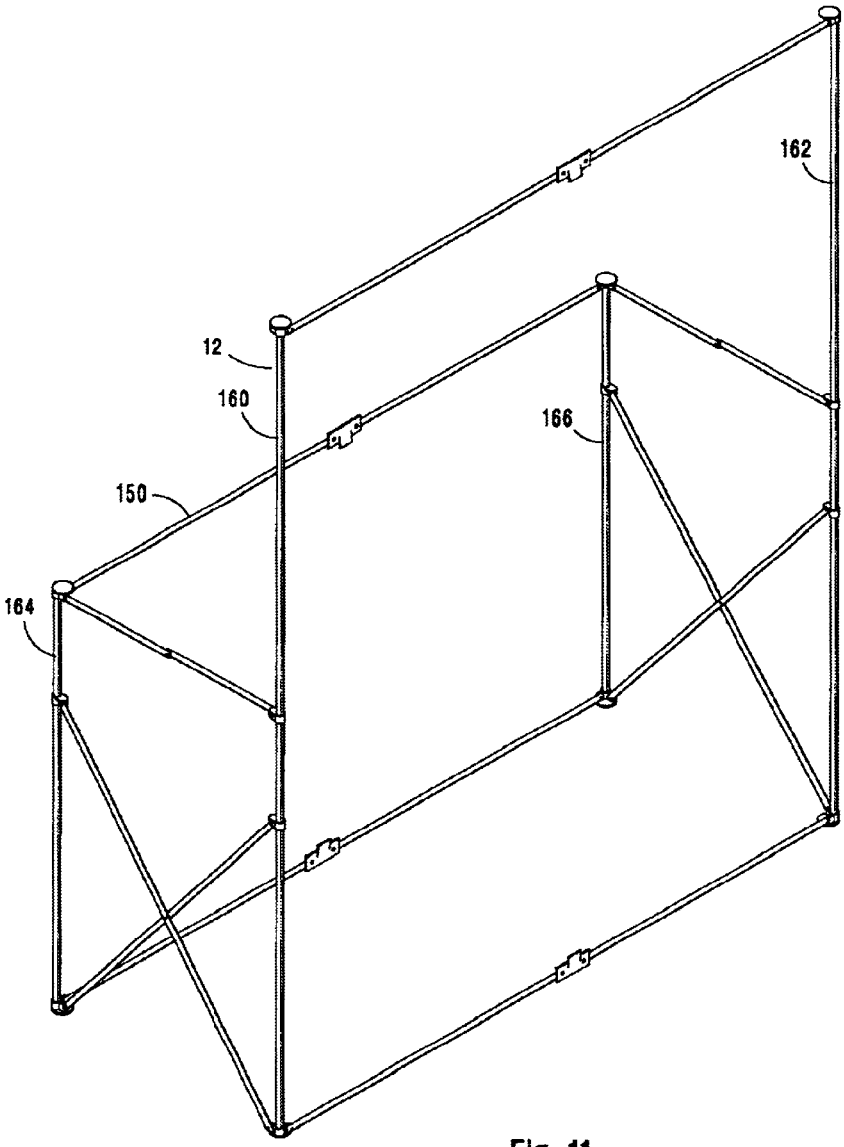
FIG. 11 is a perspective view of another alternative embodiment of the invention shown in FIGS. 8 and 9 with the frame adapted for use as a kickback.
Figure 12:
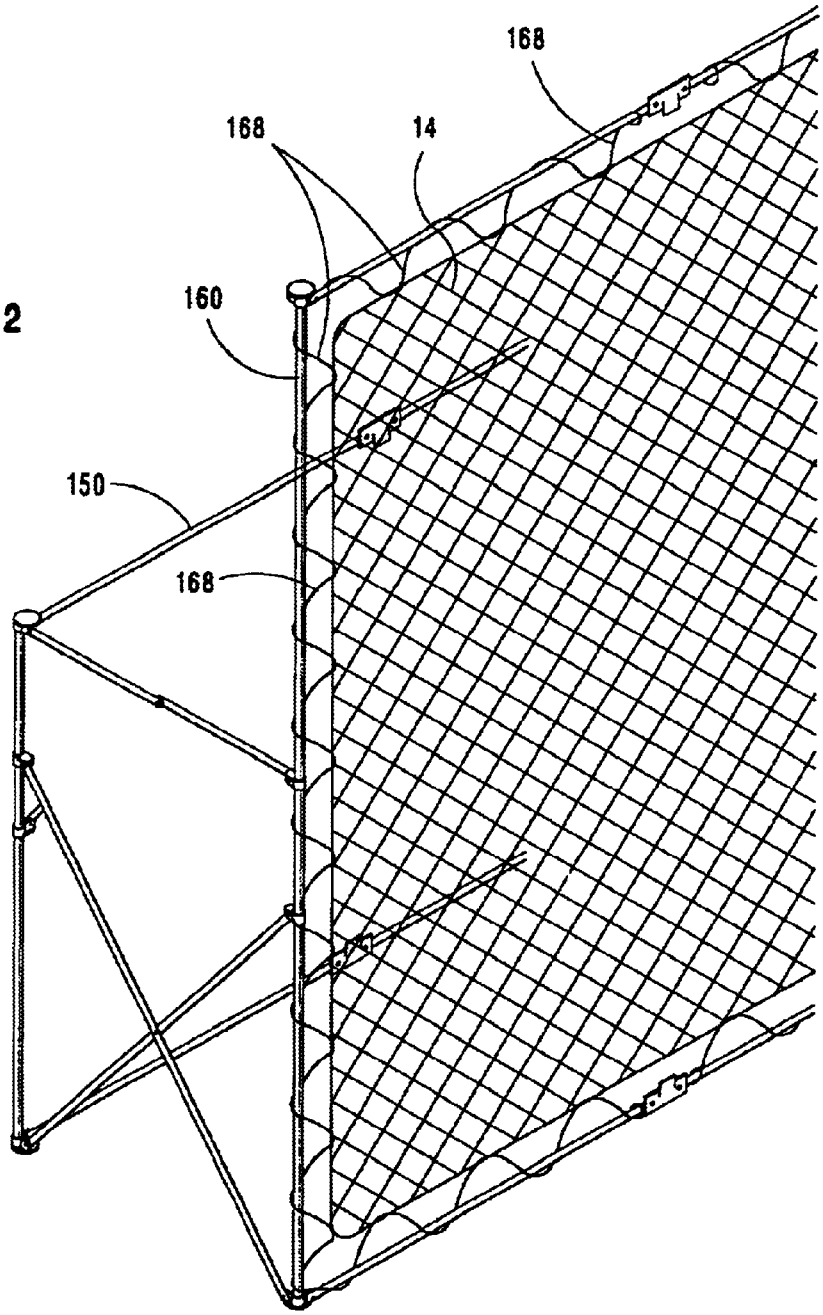
FIG. 12 is a partial perspective view of the embodiment of the invention shown in FIG. 10 with the netting applied to the frame.

FIGS. 11 and 12 illustrate another alternative embodiment of the invention wherein the frame is adapted for use as a kickback rather than a goal. As shown in FIG. 12, net 14 is secured over the front of the frame 12, rather than around the top, sides, and rear. In addition, front uprights 160 and 162 are longer than rear uprights 164 and 166 so that they extend above beyond rear crossbar 150 and the other rear components. Otherwise, the kickbacks will preferably utilize the same frame components as the previously discussed soccer and hockey goal. Net 14 is attached to the frame by elastic straps 164, shown in FIG. 12, holding the netting tight so that a ball or the like thrown against such netting will be propelled or kicked back towards the thrower by the kick-back.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A one-piece collapsible frame for a sports goal comprising:

two pairs of front and rear spaced apart vertical uprights each having coupling members provided on their upper and lower ends;

a horizontal crossbar extending between said front uprights, the crossbar comprised of first and second segments each having outer and inner ends, the outer end of the first segment pivotally secured in the coupling on the upper end of one of the front uprights and the outer end of the second segment pivotally secured in the coupling on the upper end of the other front upright, and with the inner ends of said segments releasably securable together in a horizontal position by a retaining means;

first and second support members each hinged at their midpoint, the first support member extending between one pair of front and rear uprights and pivotally secured in the couplings on the lower ends of said uprights, and the second support member extending between the other pair of front and rear uprights and pivotally secured in the couplings on the lower end of said uprights, first and second pairs of upwardly angled cross braces, the first pair pivotally extending between one pair of front and rear uprights and the second pair pivotally extending between the other pair of front and rear uprights, said cross braces each having top and bottom ends, the top end of one of the cross braces of each pair being slidably coupled to one of the rear uprights and the bottom end secured to the coupling on the lower end of the front upright, and the top end of the other cross brace slidably secured to the front upright and the bottom end secured to the coupling on the lower end of the rear upright, and a scissors type stabilizing member extending between the rear uprights, said stabilizing member comprised of a pair of hinged members the ends of one of said members which are slidably coupled to the rear uprights and the ends of the other of said members which are pivotally secured in the couplings on the upper ends of the rear uprights.

2. The frame for a sports goal of claim 1 wherein the scissors type stabilizing member is replaced with a hinged horizontal cross member extending between the rear uprights.

3. The frame for a sports goal of claim 1 wherein the first and second support members are secured to the upper ends of the front and rear uprights.

4. The frame for a sports goal of claim 1 wherein a netting is secured around the front, sides, and top of the framework.

5. The frame for a sports goal of claim 4 wherein the netting is secured to the framework using hook and loop type fasteners.

6. The frame for a sports goal of claim 1 wherein the frame is foldable both horizontally and vertically so that it can be stored in an elongated carrying bag.

7. The frame for a sports goal of claim 1 wherein the coupling members secured on the lower ends of the uprights have a flat lower surface on which the frame is supported.

8. The frame for a sports goal of claim 1 additionally comprising a hinged horizontal crossbar extending between the rear uprights and pivotally secured in the coupling members on the lower end of said uprights.

9. The frame for a sports goal of claim 1 wherein the netting is secured over the front of the frame using elastic straps so that the frame can be used as a kickback.

* * * * *